United States Patent [19]

Manson et al.

[11] 4,405,471

[45] Sep. 20, 1983

[54] AQUEOUS METAL-WORKING LUBRICANT

[75] Inventors: Mans O. Manson; Carl-Axel E. Sjögreen; Göran A. Bergvall, all of Perstorp, Sweden

[73] Assignee: Perstorp AB, Perstorp, Sweden

[21] Appl. No.: 237,479

[22] Filed: Feb. 23, 1981

[30] Foreign Application Priority Data

Feb. 29, 1980 [SE] Sweden ..... 80015837

[51] Int. Cl.[3] ..... C10M 3/26

[52] U.S. Cl. ..... 252/34; 252/41; 252/49.3; 252/49.5

[58] Field of Search ..... 252/49.5, 49.3, 34, 252/41, 565

[56] References Cited

U.S. PATENT DOCUMENTS

| | | | |
|---|---|---|---|
| 2,689,828 | 9/1954 | Smith et al. | 252/34 |
| 2,959,547 | 11/1960 | Brillhart | 252/49.3 X |
| 3,390,084 | 6/1968 | Wainwright | 252/49.3 X |
| 3,634,245 | 1/1972 | Meisters | 252/49.5 X |
| 3,928,401 | 12/1975 | Sturwold et al. | 252/49.3 X |
| 3,959,182 | 5/1976 | Kardol et al. | 252/49.5 X |
| 4,067,817 | 1/1978 | Sturwold | 252/49.3 |
| 4,157,990 | 6/1979 | Lindner et al. | 252/565 |
| 4,172,802 | 10/1979 | Rieder | 252/49.3 |

FOREIGN PATENT DOCUMENTS

| | | |
|---|---|---|
| 75783 | 10/1949 | Norway . |
| 1417615 | 12/1975 | United Kingdom . |

*Primary Examiner*—Andrew Metz

*Attorney, Agent, or Firm*—Stevens, Davis, Miller & Mosher

[57] ABSTRACT

Compound for a water dilutable metal-working lubricant characterized in that it has the formula

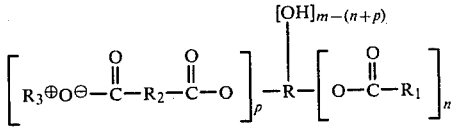

where

R consists of an alkyl rest containing 3–15 carbon atoms, $R_1$ consists of an alkyl rest, a substituted alkyl rest, an unsaturated alkyl rest, a substituted unsaturated alkyl rest, an aryl rest or a substituted aryl rest containing 4—30 carbon atoms $R_2$ consists of an alkyl rest, a substituted alkyl rest, an alkylene rest, an aryl rest, a substituted aryl rest, an alicyclic rest or a substituted alicyclic rest containing 1–20 carbon atoms and $R_3\oplus$ consists of protonized amine or an alkali metal cation m has a value between 3 and 8

$n<m$ and p has a value between 0.5 and 8, preferably 0.5–3.

4 Claims, No Drawings

AQUEOUS METAL-WORKING LUBRICANT

The present invention relates to a compound for a water dilutable metal-working lubricant, a process for the production of the compound and a use of the compound.

Lubricants based on mineral oil products are usually used at metal cutting operations, such as drilling, turning, milling, thread chasing and grinding. Sometimes the lubricants consist of aqueous emulsions. Moreover, a lot of additives, for example lubrication improving EP-additives (EP=extreme pressure) are used.

The more and more increased demand on a satisfactory working environment and labour welfare during the last few years has aroused the interest for new kinds of metal-working lubricants.

An unsatisfactory working environment and medical inconveniences connected therewith are usual troubles with the products used today in the engineering industry. Thus, the products based on mineral oil cause oil smoke and oil mist in the work-room and a fouling in and around the machines. The mineral oil and the additives used can cause skin irritation, eczema and allergies. There is a risk of cancer at a long skin contact. A risk of lung damages is also present at an inhalation of the oil mixed air.

During the last few years it has been reported from different sources about the presence of cancerous agents in cutting liquids. Mineral oil is containing polyaromatic hydrocarbons, for instance benzpyrenes. Furthermore, due to the high temperature in the cutting zone it is likely that polyaromates are formed when the products are used.

In order to reduce the above problem at the use of metal-working lubricants based on mineral oil one has more and more changed to mineral oil emulsions. Then, the problems with oil mist and oil smoke have been decreased to a certain extent. However, such products are far from rid of problems from environmental point of view.

Moreover, the mineral oil has per se a limited lubricating ability. Therefore, many different additives must be added to the lubricant. Like the mineral oil these additives can cause skin irritations. In addition to lubrication improving additives the known mineral oil emulsions must contain special emulsifiers, corrosion inhibitors and bactericides. Thus, the composition of a mineral oil emulsion is rather complicated.

Therefore, it is difficult to find out the compound or compounds causing problem in a specific case.

Accordingly, there is a great need to be able to produce a proenvironmental and high functional metal-working lubricant, i.e. a proenvironmental lubricant which by a good lubricating and cooling ability at high surface pressures and/or cutting and conversion velocities gives products of a desired look, tolerance and surface finish and at the same time a reduced wear of the tools used.

According to the present invention one has quite unexpectedly been able to meet the above need and brought about a compound for a water dilutable metal-working lubricant. The compound is characterized in that it has the formula

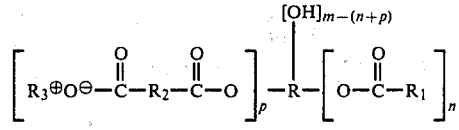

where

R consists of an alkyl radical containing 3–15 carbon atoms, $R_1$ consists of an alkyl radical, a substituted alkyl radical, an unsaturated radical, a substituted unsaturated alkyl radical, an aryl radical or a substituted aryl radical containing 4–30 carbon atoms $R_2$ consists of an alkyl radical, a substituted alkyl radical, an alkylene radical, an aryl radical, a substituted aryl radical, an alicyclic radical or a substituted alicyclic radical containing 1–20 carbon atoms and $R_3\oplus$ consists of protonized amine or an alkali metal cation m has a value between 3 and 8, $n<m$ and p has a value between 0.5 and 8, preferably 0.5–3.

Special advantages are obtained at the use of the compound according to the invention as the sole compound or the main compound in water based lubricants. Then the compound can be dissolved or emulsified in water. The solutions and emulsions respectively produced become extremely stable. Furthermore, they have an exceedingly good lubricating ability. The corrosion inhibiting properties are also quite unique. This is applicable for example to iron, iron alloys, aluminum, aluminum alloys, copper and copper alloys.

According to one embodiment a water based lubricant which is ready to be used can contain for example 70–99 percent by weight of water, preferably 90–99 percent by weight of water while the remainder or the main part of the remainder consists of the compound according to the invention.

In is remarkable that a water based lubricant containing up to 99 percent by weight of water can give a good lubricating ability and good corrosion inhibiting properties.

From environmental as well as economic point of view it is of course advantageous that a high functional lubricant containing such a high proportion of water can be produced according to the invention.

According to a second embodiment a water based lubricant which is ready to be used can contain for example 1–50 percent by weight of water while the remainder or the main part of the remainder consists of the compound according to the invention. Then the water can be dissolved or emulsified in the compound. Such a lubricant with a rather high proportion of the compound is especially suitable for such metal-working operations where the demands on film strength and lubricating ability are high.

According to a third embodiment the compound according to the invention can be used as one of the compounds in a water based lubricant, which for example can contain mineral oil, synthetic esters, polyalkyleneglycol adducts or fatty oils on vegetable or animal base. Then the compound can be used to give an improved lubricating ability, an improved corrosion inhibition and an improved emulsion stability.

According to the invention an especially suitable compound intended to be used in a water dilutable metal-working lubricant which lubricant is present as an emulsion or a solution, has the formula

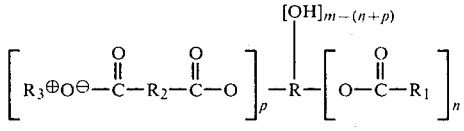

where

R consists of

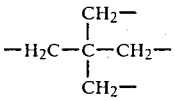

$R_1$ consists of $C_7H_{15}$ or $C_{17}H_{33}$ $R_2$ consists of $C_2H_4$, $C_3H_6$, $C_4H_8$, $C_7H_{14}$, $C_8H_{16}$, $C_2H_2$ or $C_6H_4$ $R_3\oplus$ consists of a protonized triethanolamine, diethanolamine, N,N-dimethylaminomethyl propanol, N,N-dimethyl ethanolamine or triisopropanolamine m is 4 n is 2.0–3.5 p is 0.5–2.0 and the compound is emulsified or dissolved in water.

This lubricant gives an extremely good effect for instance at grinding, drilling, thread chasing, reaming and turning.

A very suitable compound according to the invention has the formula

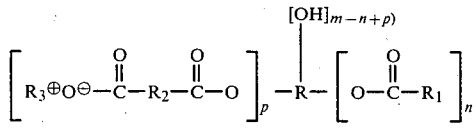

where

R has the formula

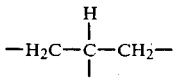

or neopentyl structure for example with the formula

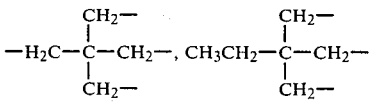

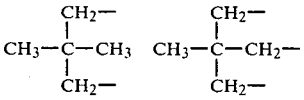

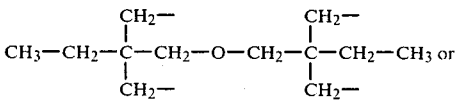

-continued

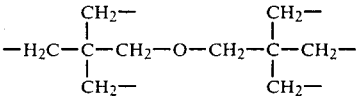

where $R_1$ for example consists of $C_4H_9$, $C_5H_{11}$, $C_6H_{13}$, $C_7H_{15}$, $C_8H_{17}$, $C_9H_{19}$, $C_{11}H_{23}$, $C_{13}H_{27}$, $C_{15}H_{31}$, $C_{17}H_{35}$, $C_{17}H_{33}$, $C_{17}H_{31}$, $C_{19}H_{39}$, $C_{21}H_{43}$, $C_{23}H_{47}$ or $C_{17}H_{34}OH$ $R_2$ for example consists of $CH_2$, $C_2H_4$, $C_3H_6$, $C_4H_8$, $C_7H_{14}$, $C_8H_{16}$, $C_2H_2$, $C_6H_4$ $C_6H_3COOH$, $C_6H_3COO^-NH_4^+$,

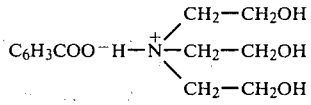

or $C_6H_{10}$ and $R_3\oplus$ consists of an ammonium ion, a protonized monoethanolamine, diethanolamine, triethanolamine, diisopropanol amine, triisopropanol amine, N,N-dimethyl ethanolamine, N,N-dimethylaminomethyl propanol, aminomethyl propanol, triethylamine or morpholine.

When $R_1$ above consists of an unsaturated radical said radical can be sulphurated. Thereby, the EP-effect of the compound can be improved still more.

Specific compounds according to the invention have the above formula, where $R_1$ consists of

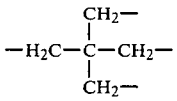

$R_1$ consists of $C_7H_{15}$ or $C_{17}H_{33}$ n is 2.0–3.5

$R_2$ consists of $C_2H_4$, $C_3H_6$, $C_4H_8$, $C_7H_{14}$, $C_8H_{16}$, $C_2H_2$ or $C_6H_4$ $R_3\oplus$ consists of a protonized triethanolamine, diethanolamine, N,N-dimethylaminomethyl propanol, N,N-dimethyl ethanolamine or triisopropanolamine p is 0.5–2.0 and m is 4.

Other specific compounds according to the invention have the above formula, where R consists of

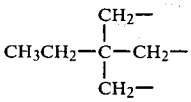

$R_1$ consists of $C_7H_{15}$ or $C_{17}H_{33}$ n is 1.0–2.5

$R_2$ consists of $C_2H_4$, $C_3H_6$, $C_4H_8$, $C_7H_{14}$, $C_8H_{16}$, $C_2H_2$ or $C_6H_4$ $R_3$ consists of a protonized triethanolamine, diethanolamine, N,N-dimethylaminomethyl propanol, N,N-dimethyl ethanolamine or triisopropanolamine p is 0.5–1.5 m is 3.

The compound according to the invention can be produced by reacting n mole of a monocarboxylic acid or a mixture of two or more monocarboxylic acids with the formula

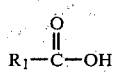

where $R_1$ consists of an alkyl radical, a substituted alkyl radical, an unsaturated alkyl radical, a substituted unsaturated alkyl radical, an aryl radical or a substituted aryl radical containing 4–30 carbon atoms per mole of an alcohol or a mixture of two or more alcohols with the formula

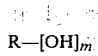

where m is 3–8 and relates to the number of hydroxy groups of the alcohol and R consists of an alkyl radical containing 3–15 carbon atoms, whereupon the reaction product obtained is reacted with p mole of a twovalent or trivalent organic acid or a mixture of two or more such acids with the formula

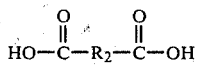

where $R_2$ consists of an alkyl radical, a substituted alkyl radical, an alkylene radical, an aryl rest, a substituted aryl radical, an alicyclic radical or a substituted alicyclic radical containing 1–20 carbon atoms or a corresponding acid anhydride or a mixture of two or more corresponding acid anhydrides to a compound with the formula

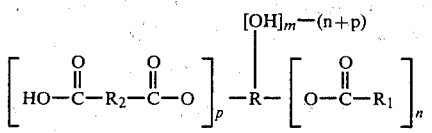

where R, $R_1$, $R_2$, m, n and p have the above meanings, n<m and p is between 0.5 and 8, preferably 0.5–3, which compound is transferred to a neutralized form by reaction with an amine or an alkali metal, whereby the compound gets the formula

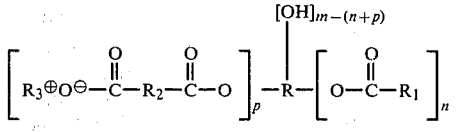

where R, $R_1$, $R_2$, m, n and p have the above meanings and $R_3\oplus$ consists of a protonized amine or an alkali metal cation.

The present invention will be explained further in connection with the embodiment examples below, of which examples 1–7 relate to the production of specific compounds according to the invention before neutralization, while examples 8–14 relate to different lubricants containing a compound according to the invention.

EXAMPLE 1

1 mole (136.2 g) trimethylol propane (TMP), 1 mole (273.3 g) oleic acid and 65 g xylene were charged into a glass bulb provided with a stirrer, a water separator, a thermometer and an inert-gas supply. The xylene was used for azeotropic removal by distillation of esterification water formed.

The temperature was raised successively to 250° C., whereupon esterification water formed was separated. At an acid number less than 3 mg KOH/g the reaction was stopped. Remaining xylene was separated under vacuum. The product obtained, 391.5 g TMP-oleate with an OH-value of 285 mg KOH/g, was a bright pale oil at 20° C.

1 mole (391.5 g) TMP-oleate as produced above was reacted at a temperature of 150° C. with 1 mole (148.2 g) phthalic anhydride in a glass bulb provided with a stirrer and a thermometer. Then 539 g TMP-oleate phthalate with an acid value of 99 mg KOH/g was obtained. The product was a viscous oil at 20° C.

EXAMPLE 2

1 mole (138.4 g) pentaerythritol (PENTA), 2.7 moles (427.1 g) pelargonic acid (an aliphatic $C_9$-acid) and 65 g xylene were charged into a glass bulb provided with a stirrer, a water separator, a thermometer and an inert-gas supply.

The temperature was raised successively to 250° C., whereupon esterification water formed was separated. At an acid number less than 3 mg KOH/g the reaction was stopped. Remaining xylene was separated under vacuum.

517 g PENTA pelargonate in the form of a bright, pale oil at 20° C. and with an OH-value of 135 mg KOH/g was obtained.

1 mole (517 g) PENTA pelargonate was reacted at a temperature of 150° C. with 1 mole (98 g) maleic acid anhydride in a glass bulb provided with a stirrer and a thermometer. Thereby, 609 g PENTA pelargonate maleate with an acid number of 88 mg KOH/g was obtained after suction filtration. The product was a bright, pale oil at 20° C.

EXAMPLE 3

1 mole (138.4 g) pentaerythritol (PENTA), 3 moles (432 g) 2-ethylhexanoic acid and 65 g toluene were charged into a glass bulb provided with a stirrer, a water separator, a thermometer and an inert-gas supply. The toluene was used for azeotropic removal by distillation of esterification water formed.

The temperature was raised successively to 250° C., whereupon esterification water formed was separated. At an acid number less than 3 mg KOH/g the reaction was stopped. Remaining toluene was separated. 517 g PENTA-2-ethylhexoate with an OH-value of 108 mg KOH/g was obtained. The product was a bright, pale oil at 20° C.

1 mole (517 g) PENTA-2-ethylhexoate was reacted with 1 mole (146.1 g) adipic acid under nitrogen gas atmosphere in a glass bulb provided with a stirrer and a thermometer in the presence of toluene and at a temperature of 250° C. The reaction was continued for 1.5 hours, whereupon esterification water formed was separated. Then the toluene was separated under vacuum.

641 g PENTA 2-ethylhexoate adipate with an acid number of 82 mg KOH/g was obtained. The product was a low viscous oil at 40° C.

EXAMPLE 4

1 mole (138.4 g) pentaerythritol (PENTA), 1 mole (273.3 g) oleic acid and 65 g xylene were charged into a glass bulb provided with a stirrer, a water separator, a thermometer and an inert-gas supply.

The temperature was successively raised to 250° C., whereupon esterification water formed was separated. At an acid number less than 1 mg KOH/g the reaction was stopped. Remaining xylene was separated under vacuum. The product was pressure filtered to remove unreacted PENTA. 370 g PENTA-oleate with an OH-value of 226 mg KOH/g was obtained. The product was a low viscous light-brown oil at 20° C.

286 g PENTA-oleate was reacted at a temperature of 150° C. with 108 g phthalic anhydride in a glass bulb provided with a stirrer and a thermometer. After a filtration 355 g PENTA-oleate phthalate with an acid number of 98 mg KOH/g was obtained. The product was a viscous oil at 20° C.

EXAMPLE 5

1 mole (136.2 g) trimethylol propane (TMP), 2.2 moles (317 g) 2-ethylhexanoic acid and 20 g xylene were charged into a glass bulb provided with a stirrer, a water separator, a thermometer and an inert-gas supply. The xylene was used for azeotropic removal by distillation of esterification water formed.

The temperature was raised successively to 260° C., whereupon esterification water formed was separated. At an acid number less than 2 mg KOH/g the reaction was stopped. Remaining xylene was separated under vacuum. 411 g TMP-2-ethylhexoate with an OH-value of 99 mg KOH/g was obtained. The product was a pale low viscous oil at 20° C.

1 mole (411 g) TMP-2-ethylhexoate and 0.8 mole (117 g) adipic acid were charged into a glass bulb provided with a stirrer, a thermometer and an inert-gas supply. The temperature was raised successively to 250° C. and kept there for 30 minutes at atmospheric pressure and then for another 30 minutes under vacuum (a pressure of 100 mm Hg). Then 514 g TMP-2-ethylhexoate adipate with an acid number of 91 mg KOH/g was obtained. The product was a low viscous oil at 40° C.

EXAMPLE 6

1 mole (517 g) PENTA-2-ethylhexoate produced according to Example 3 was reacted with 1 mole (188 g) azelaic acid at 250° C. under nitrogen gas atmosphere in a glass bulb provided with a stirrer and a thermometer. The reaction was continued for 1.5 hours at atmospheric pressure and thereafter for another 30 minutes under vacuum (a pressure of 80 mm Hg). All the time the temperature was 250° C. Then 680 g PENTA-2-ethylhexoate azelate with an acid number of 72 mg KOH/g was obtained. The product was a low viscous oil at 40° C.

EXAMPLE 7

1 mole (250 g) di-trimethylol propane (Di-TMP), 2.8 moles (403 g) 2-ethylhexanoic acid and 30 g xylene were charged into a glass bulb provided with a stirrer, a water separator, a thermometer and an inert-gas supply. The xylene was used for azeotropic water separation.

The temperature was raised slowly to 260° C., whereupon esterification water formed was separated. At an acid number less than 2 mg KOH/g the heating was interrupted and remaining xylene was separated under vacuum. 603 g Di-TMP-2-ethylhexoate with an OH-value of 109 mg KOH/g was obtained. The product was a pale low viscous oil at 20° C.

1 mole (603 g) Di-TMP-2-ethylhexoate and 1.2 moles (175 g) adipic acid were charged into a glass bulb provided with a stirrer, a thermometer and an inert-gas supply. The temperature was raised successively to 250° C. and kept there for 30 minutes at atmospheric pressure and then for another 30 minutes under vacuum (a pressure of 100 mm Hg). Then 756 g Di-TMP-2-ethylhexoate adipate with an acid number of 87 mg KOH/g was obtained. The product was a low viscous oil at 40° C.

EXAMPLE 8

25 g TMP-oleate phthalate produced according to Example 1 was mixed with 4 g N,N-dimethyl ethanolamine. The mixture obtained was charged at stirring into 550 g water, whereupon a 5 percent stable, milk like emulsion was obtained. The emulsion is very suitable as a lubricating and cooling medium for example at cutting operations, such as drilling and thread chasing.

EXAMPLE 9

25 g PENTA pelargonate maleate produced according to Example 2 was mixed with 10 g triethanolamine and 8 g nonionic emulsifier consisting of ethoxylated nonyl phenol. The mixture obtained was charged at stirring into 172 g water, whereupon a 20 percent stable, transparent emulsion was obtained. This emulsion is very suitable i.a. as a sheet metal pressing liquid for example at deep drawing of stainless steel metal.

EXAMPLE 10

25 g PENTA-2-ethylhexoate adipate produced according to Example 3 was mixed with 10 g triethanolamine. The mixture obtained was charged at stirring into 1715 g water, whereupon a 2 percent stable, semi-transparent emulsion was obtained. This emulsion is extremely suitable i.a. as a grinding liquid.

EXAMPLE 11

25 g PENTA-oleate phthalate produced according to Example 4 was mixed with 10 g triisopropanol amine. The mixture obtained was charged at stirring into 665 g water, whereupon a 5 percent stable, milk like emulsion was obtained. This emulsion is very suitable as a lubricating and cooling medium for example at cutting operations such as drilling and thread chasing.

EXAMPLE 12

25 g TMP-2-ethylhexoate adipate produced according to Example 5 was mixed with 3.6 g diethanolamine and 2.9 g diethyleneglycol monobutylether.

The mixture obtained was charged at stirring into 598 g water, whereupon a 5 percent stable, milk like emulsion was obtained. The emulsion is very suitable as a lubricating and cooling medium for example at cutting operations such as drilling and thread chasing.

EXAMPLE 13

25 g PENTA-2-ethylhexoate azelate produced according to Example 6 was mixed with 12 g triethanolamine and 3.7 g diethyleneglycol monobutylether. The mixture obtained was charged at stirring into 773 g water, whereupon a 5 percent stable, transparent emulsion was obtained. The emulsion is very suitable as a lubricating and cooling medium for example at cutting operations such as drilling and thread chasing.

EXAMPLE 14

25 g Di-TMP-2-ethylhexoate adipiate produced according to Example 7 was mixed with 5.2 g N,N-dimethylaminomethyl propanol and 3.0 g diethyleneglycol monobutylether. The mixture obtained was charged at stirring into 627 g water, whereupon a 5 percent stable, milk like emulsion was obtained. The emulsion is very suitable as a lubricating and cooling medium for example at cutting operations such as drilling and thread chasing.

The invention is not limited to the embodiments shown, since these can be modified in different ways within the scope of the present invention.

We claim:

1. A water dilutable metal-working lubricant composition, comprising an emulsion or an aqueous solution containing 1-30% by weight of a compound having the formula

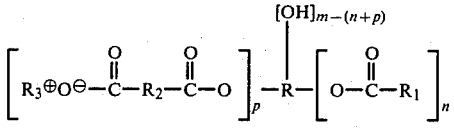

wherein

R is an alkyl radical containing 3-15 carbon atoms;

$R_1$ is an alkyl radical, an unsaturated hydrocarbon radical or an aryl radical containing 4-30 carbon atoms;

$R_2$ is an alkyl radical, an unsaturated hydrocarbon radical, an aryl radical or an alicyclic radical containing 1-20 carbon atoms;

$R_3\oplus$ is a protonized amine or an alkali metal cation;

m has a value between 3 and 8;

n<m; and p has a value between 0.5 and 8;

and 99-70% by weight of water.

2. A water dilutable metal-working lubricant composition according to claim 1, comprising an emulsion or an aqueous solution containing 1-30% by weight of a compound having the formula

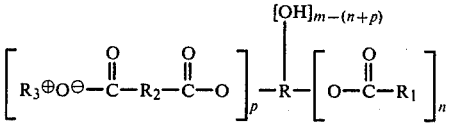

where

R has the formula

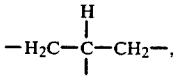

or a neopentyl structure having the formula

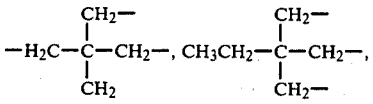

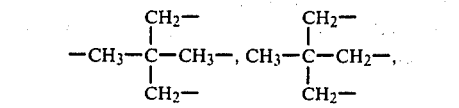

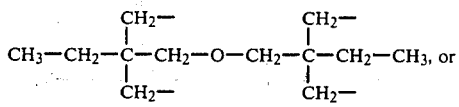

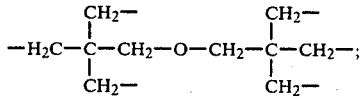

$R_1$ is $C_4H_9$, $C_5H_{11}$, $C_6H_{13}$, $C_7H_{15}$, $C_8H_{17}$, $C_9H_{19}$, $C_{11}H_{23}$, $C_{13}H_{27}$, $C_{15}H_{31}$, $C_{17}H_{35}$, $C_{17}H_{33}$, $C_{17}H_{31}$, $C_{19}H_{39}$, $C_{21}H_{43}$, $C_{23}H_{47}$, or $C_{17}H_{34}OH$;

$R_2$ is $CH_2$, $C_2H_4$, $C_3H_6$, $C_4H_8$, $C_7H_{14}$, $C_8H_{16}$, $C_2H_2$, $C_6H_4$, $C_6H_3COOH$, $C_6H_3COO^-NH_4^+$,

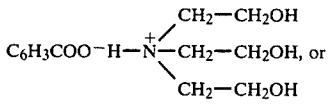

$C_6H_{10}$; and $R_3\oplus$ is an ammonium ion or a protonized amine, which amine is a monoethanolamine, diethanolamine, triethanolamine, diisopropanol amine, triisopropanolamine, N,N-dimethylethanolamine, N,N-dimethyl-aminomethyl propanol, aminomethyl propanol, triethylamine, or morpholine; and 99-70% by weight of water.

3. A metal-working lubricant composition according to claim 1 or 2 comprising an emulsion or an aqueous solution containing 1-30% by weight of a compound having the formula

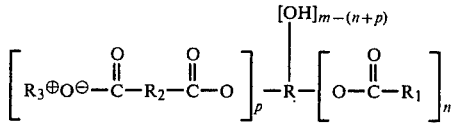

where

R is

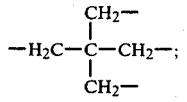

$R_1$ is $C_7H_{15}$ or $C_{17}H_{33}$;

$R_2$ is $C_2H_4$, $C_3H_6$, $C_4H_8$, $C_7H_{14}$, $C_8H_{16}$, $C_2H_2$, or $C_6H_4$;

$R_3\oplus$ is a protonized amine which amine is triethanolamine, diethanolamine, N,N-dimethylaminomethyl propanol, N,N-dimethyl ethanolamine, or triisopropanolamine;

m is 4;

n is 2.0–3.5; and p is 0.5–2.0 and 99–70% by weight of water.

4. A metal working lubricant composition according to claim 1 or 2 comprising an emulsion or an aqueous solution containing 1–30% by weight of a compound having the formula

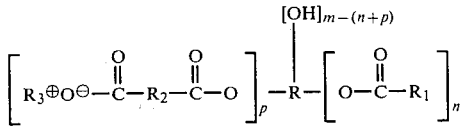

where

R is

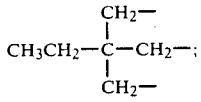

$R_1$ is $C_7H_{15}$ or $C_{17}H_{33}$;

n is 1.0–2.5;

$R_2$ is $C_2H_4$, $C_3H_6$, $C_4H_8$, $C_7H_{14}$, $C_8H_{16}$, $C_2H_2$, or $C_6H_4$;

$R_3$ is a protonized amine which amine is triethanolamine, diethanolamine, N,N-dimethylaminomethyl propanol, N,N-dimethyl ethanolamine, or triisopropanolamine p is 0.5–1.5; and m is 3;

and 99–70% by weight of water.

* * * * *